US010888767B2

(12) United States Patent
Shigeta

(10) Patent No.: US 10,888,767 B2
(45) **Date of Patent: *Jan. 12, 2021**

(54) CARD SHOOTER DEVICE AND CARD STORAGE METHOD

(71) Applicant: ANGEL PLAYING CARDS CO., LTD., Shiga (JP)

(72) Inventor: Yasushi Shigeta, Shiga (JP)

(73) Assignee: ANGEL PLAYING CARDS CO., LTD., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/787,773

(22) Filed: Feb. 11, 2020

(65) Prior Publication Data

US 2020/0171374 A1 Jun. 4, 2020

Related U.S. Application Data

(63) Continuation of application No. 15/311,186, filed as application No. PCT/JP2015/002459 on May 15, 2015, now Pat. No. 10,596,449.

(51) Int. Cl.
*A63F 1/10* (2006.01)
*A63F 1/14* (2006.01)

(52) U.S. Cl.
CPC . *A63F 1/10* (2013.01); *A63F 1/14* (2013.01)

(58) Field of Classification Search
USPC ..... 273/148 A
See application file for complete search history.

(56) References Cited

U.S. PATENT DOCUMENTS 3,706,873 A * 12/1972 Nodine ..... G06K 1/12 235/495
4,969,648 A * 11/1990 Hollinger ..... A63F 1/12 273/149 R (Continued)

FOREIGN PATENT DOCUMENTS

AU 2012265558 A1 5/2014
CN 103052428 A 4/2013

(Continued)

OTHER PUBLICATIONS

Extended European Search Report dated Aug. 28, 2019 for EP Application No. 19180355.0 cites the patent documents above.

(Continued)

*Primary Examiner* — John E Simms, Jr.
*Assistant Examiner* — Dolores R Collins
(74) *Attorney, Agent, or Firm* — Norton Rose Fulbright US LLP

(57) ABSTRACT

A card shooter device includes a main unit with a card storage section storing cards constituting a predetermined number of decks, a removable top face cover, arranged on top of the card storage section, for covering the card storage section, a bottom face, inclined forward, for guiding the cards onto a game table from the card storage section, and a front cover, arranged in front of the main unit so that the cards can be extracted one by one from the card storage section, in which the front cover is removable from the main unit in cooperation with an engagement member provided in front of the main unit, and is adapted to be able to store the cards constituting the predetermined number of decks in the card storage section when the front cover is removed.

9 Claims, 15 Drawing Sheets

(56) References Cited

U.S. PATENT DOCUMENTS

| | | | | |
|---|---|---|---|---|
| 5,669,816 | A | 9/1997 | Garczynski | |
| 5,762,203 | A * | 6/1998 | Klawiter | B65D 5/522 206/736 |
| 5,941,769 | A * | 8/1999 | Order | A63F 1/18 463/12 |
| D432,588 | S * | 10/2000 | Tedham | D2/396 |
| 7,537,216 | B2 * | 5/2009 | Soltys | A63F 1/14 273/148 R |
| 7,699,694 | B2 * | 4/2010 | Hill | A63F 1/18 463/11 |
| 7,866,667 | B2 * | 1/2011 | Fruchtman | A63F 1/06 273/148 A |
| 9,566,501 | B2 * | 2/2017 | Stasson | A63F 1/12 |
| 2004/0259618 | A1 * | 12/2004 | Soltys | A63F 1/02 463/11 |
| 2005/0103667 | A1 * | 5/2005 | Tippey | B65D 75/5833 206/440 |
| 2005/0178754 | A1 | 8/2005 | Goodwin | |
| 2005/0178784 | A1 | 8/2005 | Waclawek | |
| 2007/0273094 | A1 * | 11/2007 | Fleckenstein | A63F 1/12 273/149 P |
| 2009/0121429 | A1 | 5/2009 | Walsh | |
| 2013/0020341 | A1 * | 1/2013 | Bogdziewicz, III | B65D 5/725 221/1 |
| 2013/0207344 | A1 | 8/2013 | Shigeta | |
| 2013/0277911 | A1 | 10/2013 | Shigeta | |
| 2013/0300060 | A1 * | 11/2013 | Kyrychenko | A63F 1/12 273/149 R |
| 2014/0033660 | A1 | 2/2014 | Shigeta | |
| 2016/0022097 | A1 * | 1/2016 | Bengtsson | B65D 75/5827 206/494 |
| 2017/0072296 | A1 * | 3/2017 | Stasson | A63F 1/12 |
| 2017/0095727 | A1 | 4/2017 | Shigeta | |

FOREIGN PATENT DOCUMENTS

| | | | |
|---|---|---|---|
| JP | 2003250950 | A | 9/2003 |
| JP | 2014031217 | A | 2/2014 |
| JP | 2014-064867 | A | 4/2014 |
| JP | 6363183 | B2 | 7/2018 |
| WO | 2009126780 | A2 | 10/2009 |
| WO | 2012167004 | A2 | 12/2012 |
| WO | 2014024239 | A1 | 2/2014 |
| WO | 2014049946 | | 4/2014 |
| WO | 2014061066 | A1 | 4/2014 |

OTHER PUBLICATIONS

Japanese language Office Action dated May 14, 2019 for corresponding Japanese application No. 2018-121504 cites the patent documents above.

Chinese language Office Action dated Apr. 12, 2019 for corresponding Chinese application No. 201580025328. 1 cites the patent documents above.

Machine Translation of Japanese Patent Application Publication No. JP 2003-250950 to Danbonetto Systems KK, dated Sep. 9, 2003 (Patent Abstracts of Japan).

Japanese Office Action dated Aug. 29, 2017 for JP Application 2016-519123 cites the patent documents above.

International Search Report, dated Jun. 30, 2015, for PCT International Application No. PCT/JP2015/002459, filed May 15, 2015.

* cited by examiner

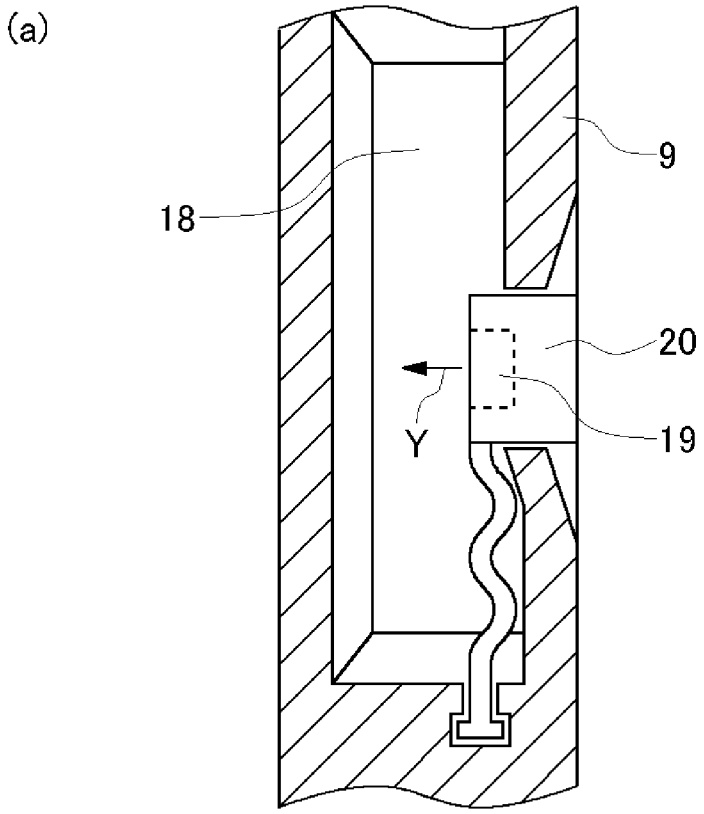
Fig. 7A
Fig. 7B
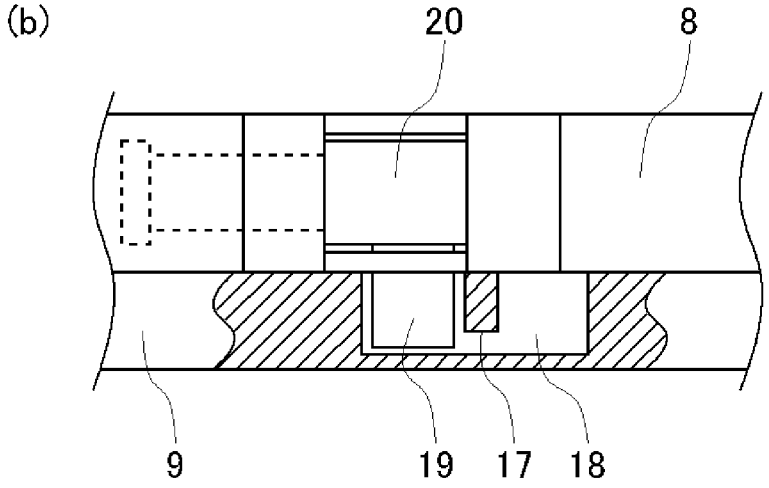

(a)

(b)

CARD SHOOTER DEVICE AND CARD STORAGE METHOD

CROSS REFERENCE TO RELATED APPLICATIONS

This application is a continuation from U.S. patent application Ser. No. 15/311,186 filed Nov. 14, 2016, which is the national stage, under 35 U.S.C. § 371, of International Application No. PCT/JP2015/002459 filed May 15, 2015, which claims priority to JP Application No. 2014-115255 filed May 15, 2014; the contents of each of which are incorporated herein by reference.

DESCRIPTION

Technical Field

The present invention relates to a card shooter device used for a playing game, and to a card shooter device capable of storing playing cards (hereinafter referred to as "cards"), particularly cards constituting a predetermined number of decks at one time without lifting the cards and a card packing box containing the cards, and a card storage method.

Background Art

In various types of playing games such as poker, baccarat, bridge, and blackjack, a dealer stores one or more decks of cards in a card shooter device, extracts the cards one by one therefrom, and deals the cards to game players. Generally, a widely practiced way of storing cards in the card shooter device is that the dealer opens a top face cover on the top of the card shooter device, collectively lifts the one or more decks of cards by hand at one time, and stores the cards (see, e.g., Patent Literature 1).

The cards used in various types of playing games such as poker, baccarat, bridge, and blackjack are stored in a card shooter device for use in a unit of six to ten decks of cards. Eight decks of cards include 416 cards, and the bulk thereof is approximately 125 millimeters. Already-shuffled cards constituting a predetermined number of decks are extracted from a packing box or are exposed by opening a part of the packing box, in which state a cut card is inserted among the cards, and thereafter stored in the card shooter device. To fairly play the playing game, a dealer must keep a state where only respective back surfaces of the cards can be seen for game players until the packing box is opened to store the cards in the card shooter device. When the cards are being stored in the card shooter device, the cards must also be collectively lifted by hand without breaking the deck after a top face cover in the card shooter device is opened. In the meantime, a card storage section in the card shooter device has a distance between its side surface portions that is substantially the same as the size of respective side surfaces of the cards so that the cards are not scattered therein and the order of the cards is not changed. When the card shooter device stores eight decks of cards, there are only several centimeters left in its depth. Thus, when the dealer attempts to lift and store cards constituting a predetermined number of decks at one time, the dealer cannot handle the cards well to insert them. For example, a mistake of erroneously scattering the eight decks of cards is likely to occur because the first one of the cards is caught by the card shooter device to break the deck. The cards, which have been scattered on a game table, cannot be used for a game, which constitutes a factor preventing the game from being efficiently operated.

PATENT LITERATURE

Patent Literature 1: International Publication No. WO 2014/024239

SUMMARY OF INVENTION

The present invention has been made under the foregoing background. An object of the present invention is to provide a card shooter device which makes it easy for a dealer to store cards in a card storage section in the card shooter device prior to a playing game and further prevents a mistake of erroneously scattering the cards to break a deck, and a method for storing the cards.

According to one aspect of the present invention, there is provided a card shooter device, the card shooter device including a main unit including a card storage section storing cards constituting a predetermined number of decks, a removable top face cover, arranged on top of the card storage section, for covering the card storage section, a bottom face, inclined forward, for guiding the cards onto a game table from the card storage section, and a front cover arranged in front of the main unit so that the cards can be extracted one by one from the card storage section, in which the front cover is removably mounted on the main unit in cooperation with an engagement member provided in front of the main unit, and wherein when the front cover is mounted, the front cover restricts forward movement of the cards constituting the predetermined number of decks stored in the card storage section while creating an opening through which the cards can pass one by one between the front cover and the bottom face, and while the front cover is removed, the front cover provides a front face opened state where the cards can be slid and stored in the card storage section from the front of the main unit while being guided by the bottom face.

According to another aspect of the present invention, there is provided a method for storing cards, the method for storing cards being a method using a packing box storing cards constituting a predetermined number of decks to store the cards in the packing box in a card shooter device for dealing the cards on a game table, in which the packing box has a rectangular parallelepiped shape, includes a cut line parallel to a longitudinal direction of a rectangular parallelepiped, and is adapted to be able to expose respective side surfaces of the cards within the packing box by dividing the packing box along the cut line to remove a left or right side surface of the packing box, and the card shooter device includes a main unit including a card storage section storing the cards constituting the predetermined number of decks, and a bottom face, inclined forward, for guiding the cards onto the game table from the card storage section, and a front cover provided in front of the main unit and removably mounted on the main unit in cooperation with an engagement member, the method including a step of removing a top face cover arranged on top of the card storage section in the card shooter device, a step of removing the front cover from the main unit in the card shooter device, a side surface exposure step of preparing the packing box storing the cards constituting the predetermined number of decks, and exposing the side surfaces of the cards in the packing box by dividing the packing box along the cut line in the packing box to remove the left or right side surface of the packing box, a card cutting step of inserting a cut card among the cards in the packing box with the side surfaces exposed, a card storage step of sliding and storing the cards in the card storage section while the cards, together with the packing box the side surface of which is removed, are guided by the bottom face from the front of the main unit from which the front cover is removed, and a storage completion step of removing the packing box from the card storage section and leaving only the cards in the card storage section.

The present invention makes it easy to store the cards in the card storage section in the card shooter device prior to the playing game, prevents a mistake of erroneously scattering the cards to break a deck, and further leads to an improvement in work efficiency of a game in a casino.

As described below, other aspects exist in the present invention. Therefore, the disclosure of the present invention is intended to provide some of the aspects of the present invention, and is not intended to restrict the scope of the invention described and claimed herein.

BRIEF DESCRIPTION OF DRAWINGS

FIG. 7A is a broken view in a horizontal direction of the locking device in the engagement member in the card shooter device.

FIG. 7B is a broken view in a vertical direction of the locking device in the engagement member in the card shooter device.

DESCRIPTION OF EMBODIMENTS

Details of the present invention will be described below. However, the following detailed description and attached drawings are not limited to the invention.

Figure 1A:
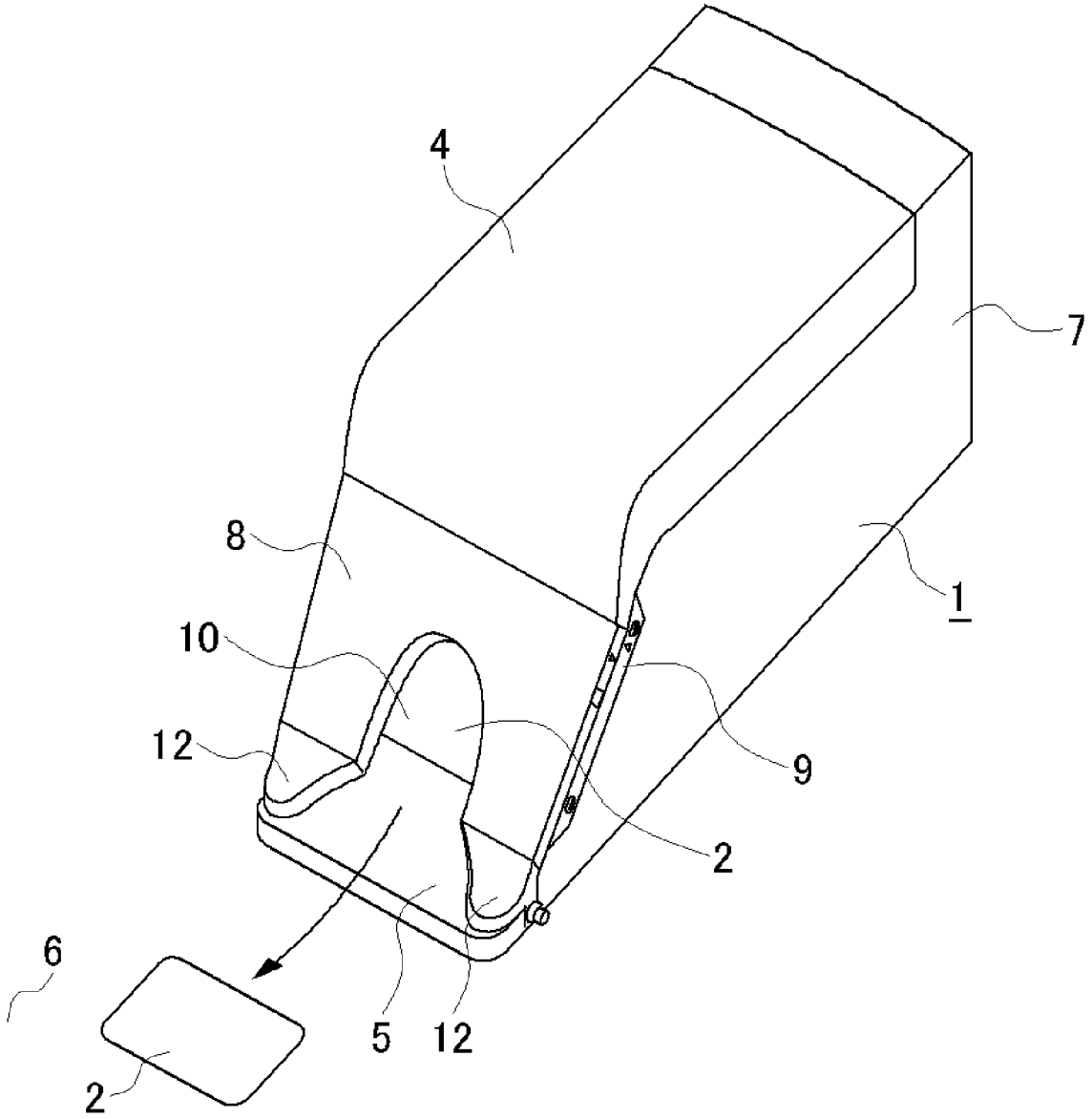
FIG. 1A is a perspective view of a card shooter device according to an embodiment 1 of the present invention.
Figure 1B:
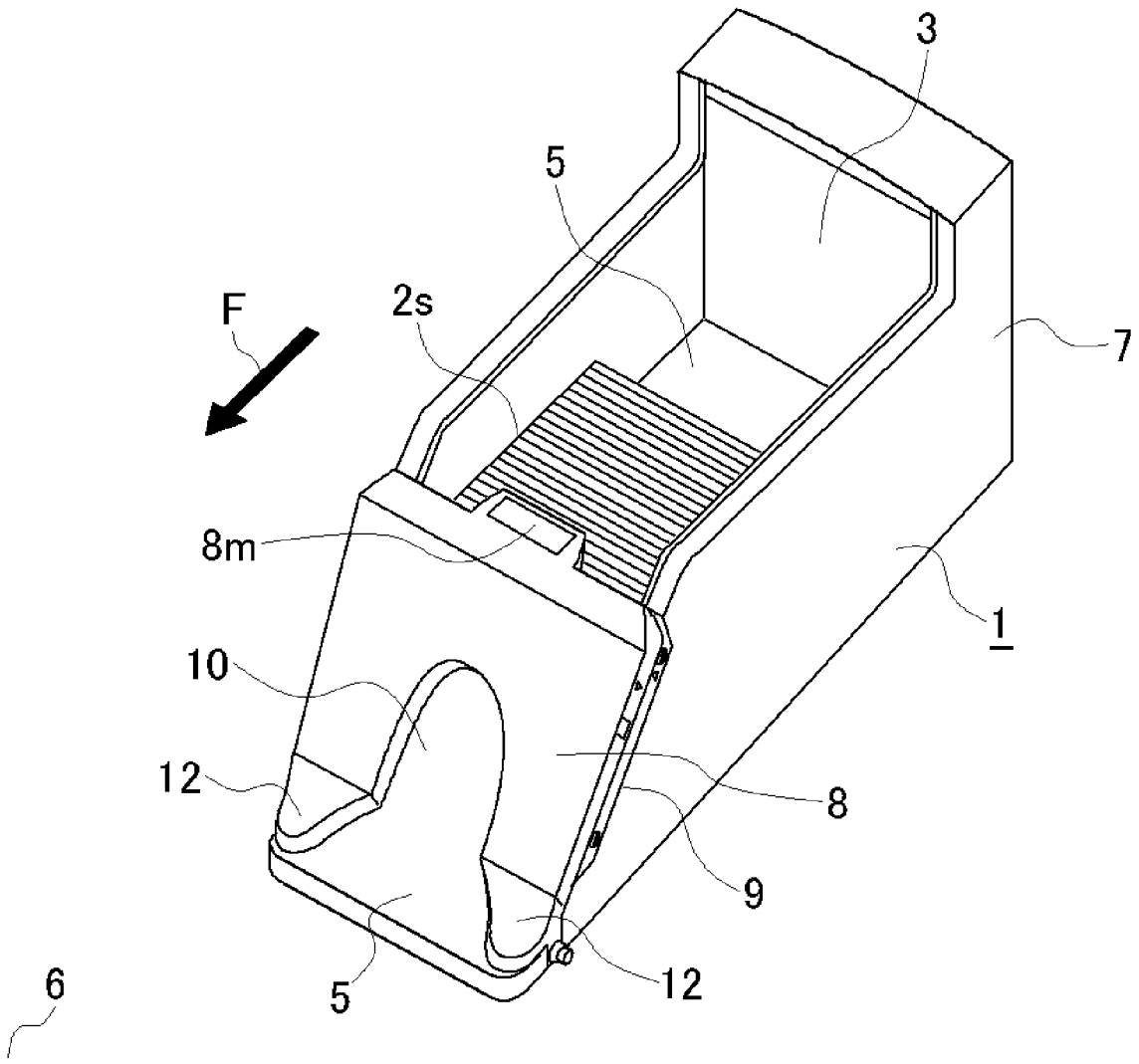
FIG. 1B is a perspective view of the card shooter device in a state where a top face cover is removed.
Figure 1C:
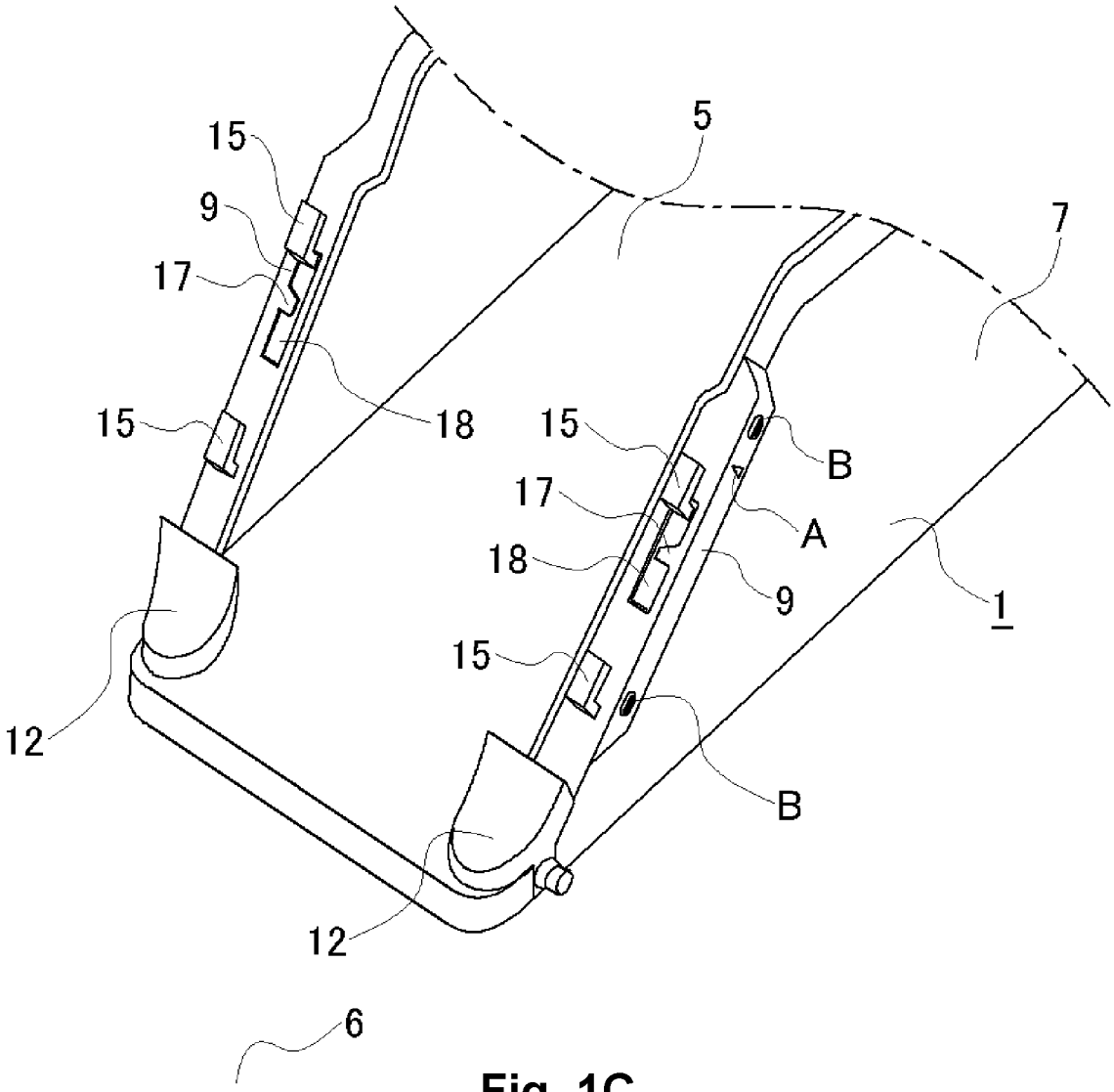
FIG. 1C is an enlarged perspective view of a principal part of the card shooter device in a state where the top face cover and a front cover are removed.

An embodiment 1 of the present invention will be described. FIGS. 1A-C are respectively perspective views of a card shooter device 1 according to the embodiment 1, and respectively illustrate different states. In the card shooter device 1, a main unit 7 including a card storage section 3 storing cards 2*s* constituting a predetermined number of decks and a removable top face cover 4 for covering the card storage section 3 on top of the card storage section 3 are arranged. In the card storage section 3, a bottom face 5 for supporting the cards 2*s* stored in the card storage section 3 and guiding a card 2 onto a game table 6 from the front is formed in the main unit 7. Further, a front cover 8 is arranged in front of the main unit 7 in the card shooter device 1 so that the cards are extracted one by one from the card storage section 3. The front cover 8 is removably mounted on the card shooter device 1 in cooperation with an engagement member 9 provided in front of the card shooter device 1, to restrict movement in a direction indicated by a forward arrow F of the cards 2*s* constituting the predetermined number of decks stored in the card storage section 3 when the front cover 8 is mounted while being adapted to have an opening 10 through which the cards 2 can pass one by one formed between the front cover 8 and the bottom face 5. When the front cover 8 is removed, the cards 2*s* constituting the predetermined number of decks can be stored in the card storage section 3. When a magnet is provided on the top of the front cover 8, mounting of the top face cover 4 on the main unit 7 can be stabilized. Further, as described in FIG. 1D, there are protrusions 11 at an end on the back of the top face cover 4, and the protrusions 11 can be respectively caught by locking members 2 in the card shooter device 1 to serve as a bridge so that a slope continuing to the bottom face 5 from the top face cover 4 can be formed.

Figure 2:
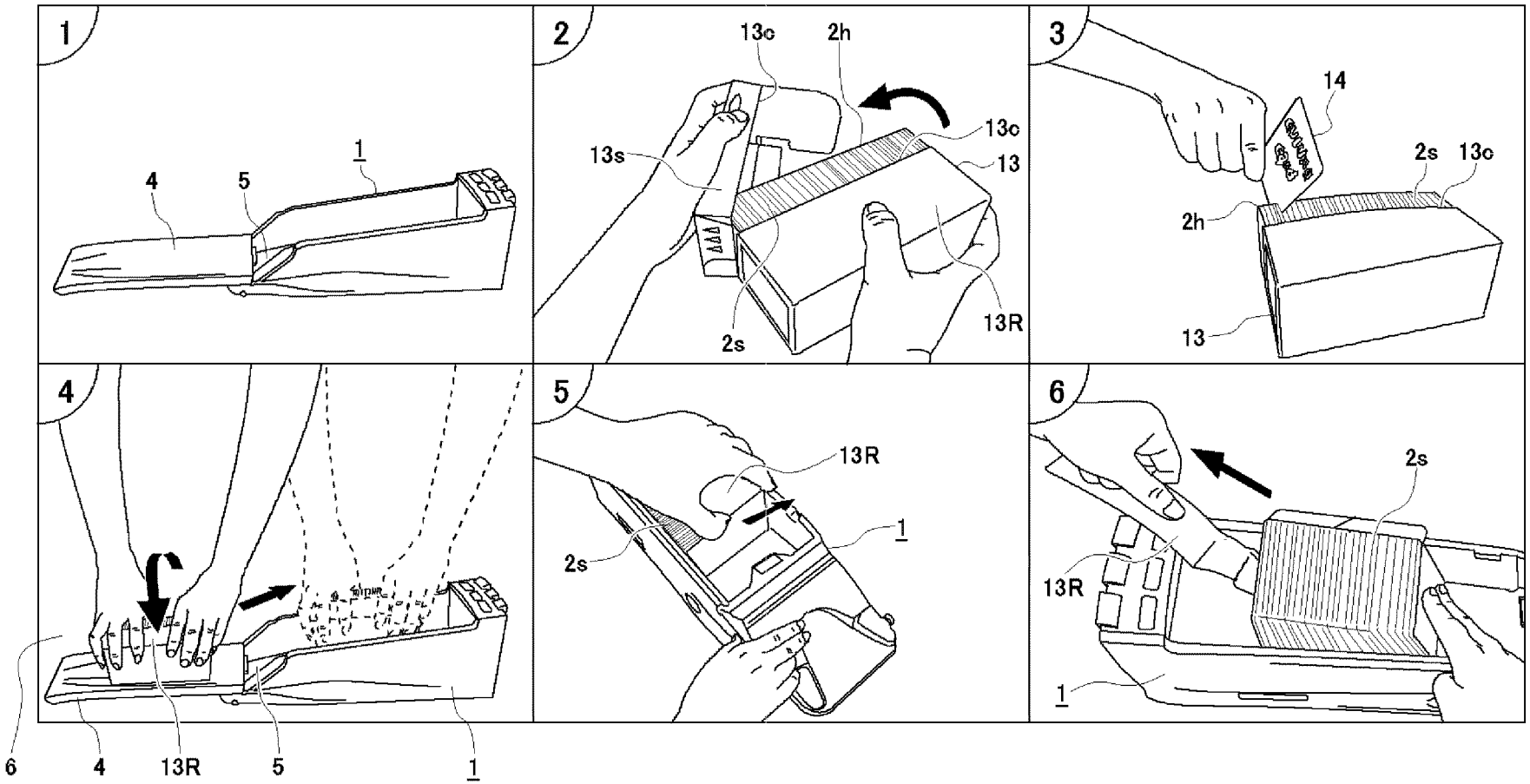
FIG. 2 is an explanatory view of a procedure for opening a packing box and extracting shuffled cards from the packing box and storing the shuffled cards in the card shooter device.
Figure 3:
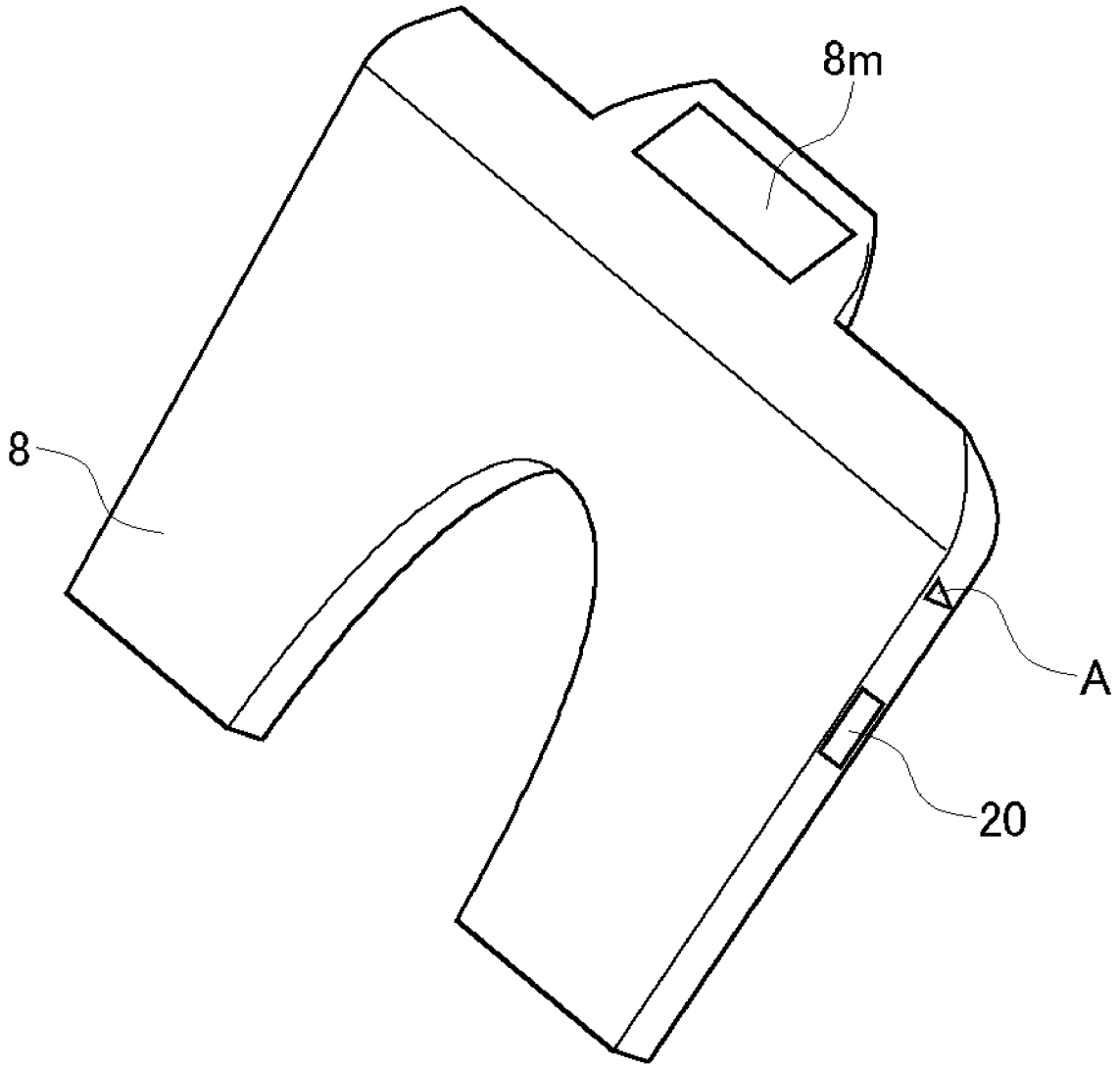
FIG. 3 is a perspective view of a front cover removable from the card shooter device.

A method using the packing box 13 storing the cards 2*s* constituting the predetermined number of decks to store the cards 2 in the packing box 13 in the card shooter device 1 for dealing the cards 2 on the game table 6 will be described with reference to FIG. 2. The above-described packing box 13 has a rectangular parallelepiped shape, includes a cut line 13*c* parallel to a longitudinal direction of a rectangular parallelepiped, and is adapted to be able to expose respective side surfaces of the cards 2*s* within the packing box 13 when the packing box 13 is divided along the cut line 13*c* to remove a left or right side surface of the packing box 13, and the card shooter device 1 includes the main unit including the card storage section 3 storing the cards 2*s* constituting the predetermined number of decks, the bottom face 5, inclined forward, for guiding the cards 2 onto the game table 6 from the card storage section 3, and the front cover 8 provided in front of the main unit 7 and removably mounted on the main unit 7 in corporation with the engagement member 9.

This method includes (1) a step of removing a top face cover 4 arranged on top of the card storage section 3 in the card shooter device 1 (a top face cover removal step), (2) a step of removing the front cover 8 from the main unit 7 in the card shooter device 1 (a front cover removal step), (3) a step of preparing the packing box 13 storing the cards 2*s* constituting the predetermined number of decks, dividing the packing box 13 along the cut line 13*c* in the packing box 13 and removing the left or right side surface of the packing box 13 to expose the respective side surfaces of the cards 2*s* in the packing box 13 (a card side surface exposure step: indicated by 2 in FIG. 2), (4) a step of inserting a cut card 14 among the cards 2*a* in the packing box 13 with the side surfaces exposed (a cut card insertion step: indicated by 3 in FIG. 2), (5) a step of storing the cards 2*s* after the cards 2*s*, together with a part of the packing box 13, are slid into the card storage section 3 while being guided by the bottom face 5 from the front of the main unit 7 from which the front cover 8 is removed (a card 2*s* storage step: indicated by 4 in FIG. 2), and (6) a step of removing the packing box 13 from the card storage section 3 and leaving only the cards 2*s* in the card storage section 3 (a storage completion step: indicated by 6 in FIG. 2), and the cards 2*s* are stored in the card storage section 3.

The number of cut lines in the packing box 13 is not limited to one. For example, a packing box 13 including two cut lines can also be used. First, after either one of left and right side surfaces of the packing box 13 including the two cut lines is removed, the cut card 14 is inserted thereinto (step (4)). Then, after the other side surface is removed, the cards 2*s* may be stored in the card storage section 3 with the cards 2*s* retained in a left central band-shaped portion, i.e., with both the side surfaces of the card 2*s* exposed.

Figure 1D:
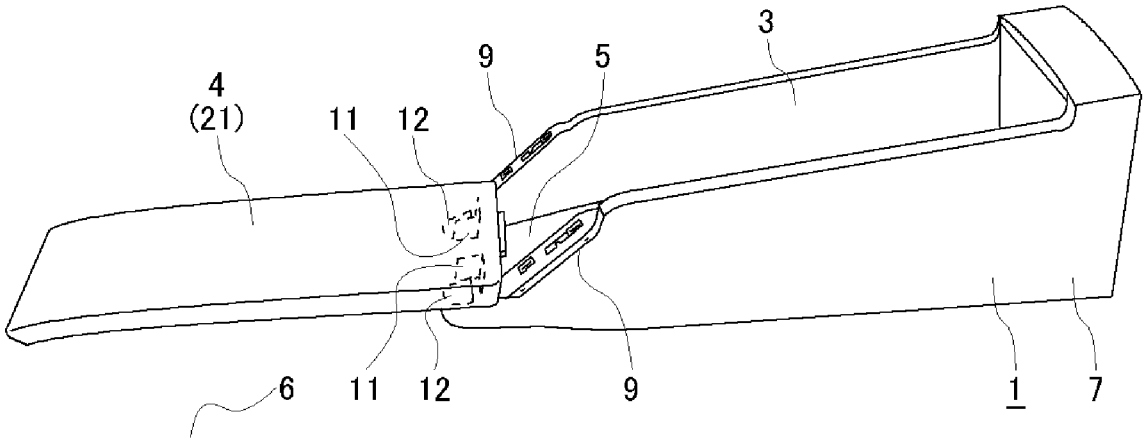
FIG. 1D is a perspective view of the card shooter device in a state where the top face cover and the front cover are removed and an end of the top face cover is locked into the front of a main unit in the card shooter device.

As described in FIG. 1D, an extension member 21 forming a structure serving as a bridge with an upper surface of the game table 6 can be arranged at a leading end of the front of the card shooter device 1. The cards 2*s*, together with a part of the packing box 13, can be slid from an upper surface of the extension member 21 and stored in the card storage section 3. This figure illustrates an example in which the structure serving as the bridge with the upper surface of the game table 6 is formed at the leading end of the front of the card shooter device 1 using the top face cover 4 as the extension member 21 (indicated by reference numerals 1 and 4 in FIG. 2).

Thus, according to the embodiment of the present invention, the top face cover 4 arranged on top of the card storage section 3 in the card shooter device 1 is first removed, and the card 2 is removed if left in the card storage section 3. Further, after the cards 2*s* are stored in the card storage section 3, the front cover 8, which has been removed from the main unit, is mounted on the card shooter device 1 (indicated by 5 in FIG. 2), and the storage completion step (6) is then performed.

Figure 4:
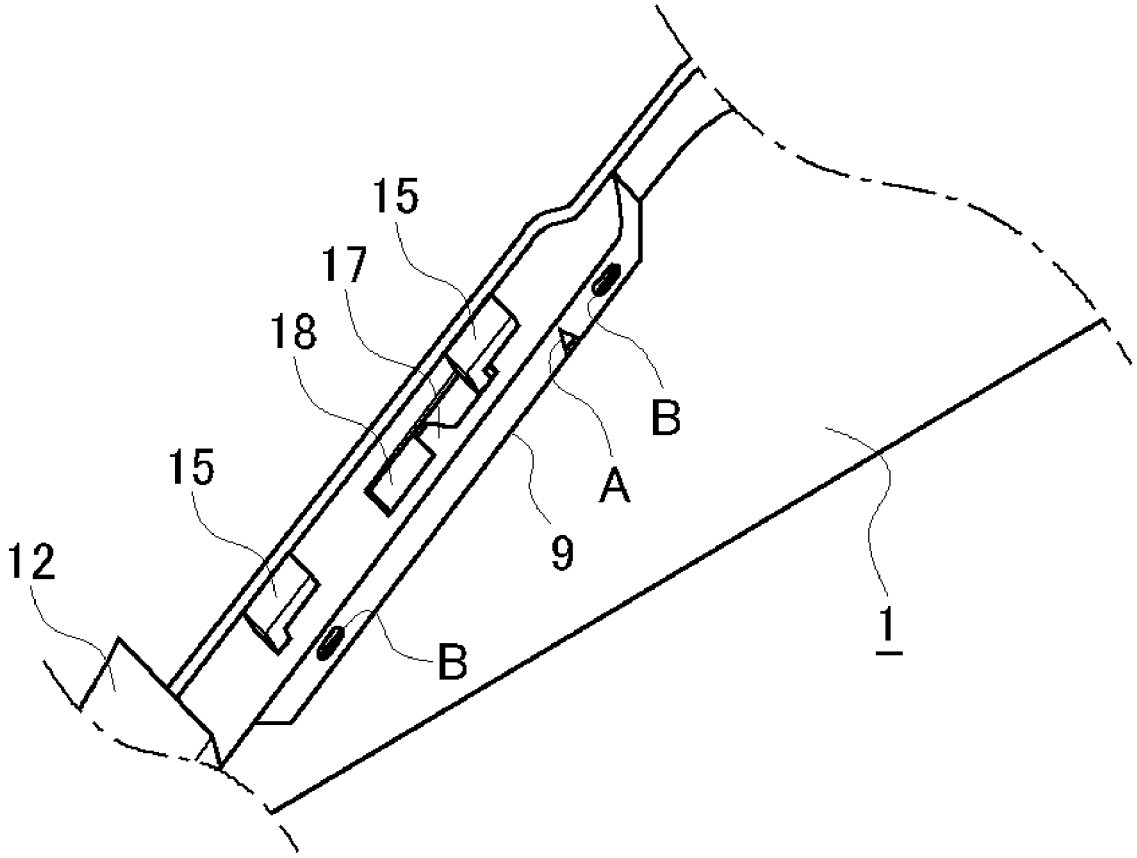
FIG. 4 is a perspective view of an engagement member for removably mounting the front cover on the card shooter device.

A detailed structure of the engagement member 9 for removably mounting the front cover 8 on the card shooter device 1 will be described below with reference to FIGS. 3-7. As illustrated in FIG. 4, two L-shaped hooks 15 are provided in the engagement member 9 fixed to the card shooter device 1 with bolts B. Two L-shaped hook receiving sections 16 in an opposite direction to the two L-shaped hooks 15 are provided on the back, mounted on the engagement member 9, of the front cover 8. When the front cover 8 is slid along an obliquely downward arrow X from above the engagement member 9 while respective marks A in both the members match each other, as illustrated in FIG. 5, the two hooks 15 in the engagement member 9 and the two hook receiving sections 16 in the front cover 8 mesh with each other.

Figure 5:
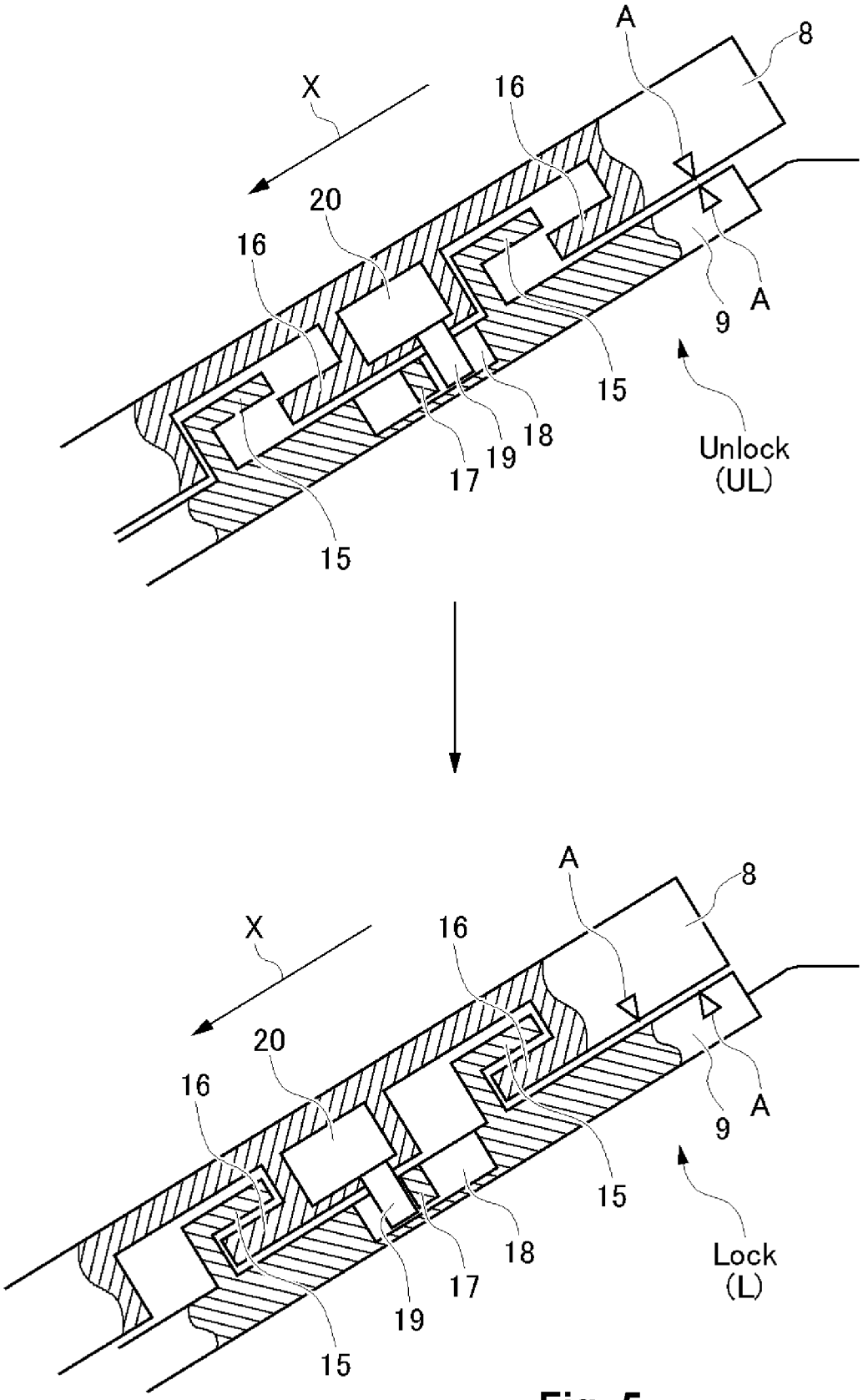
FIG. 5 is a schematic explanatory view illustrating a state where the engagement member in the card shooter device and a hook receiving section in the front cover engage with each other.
Figure 6A:
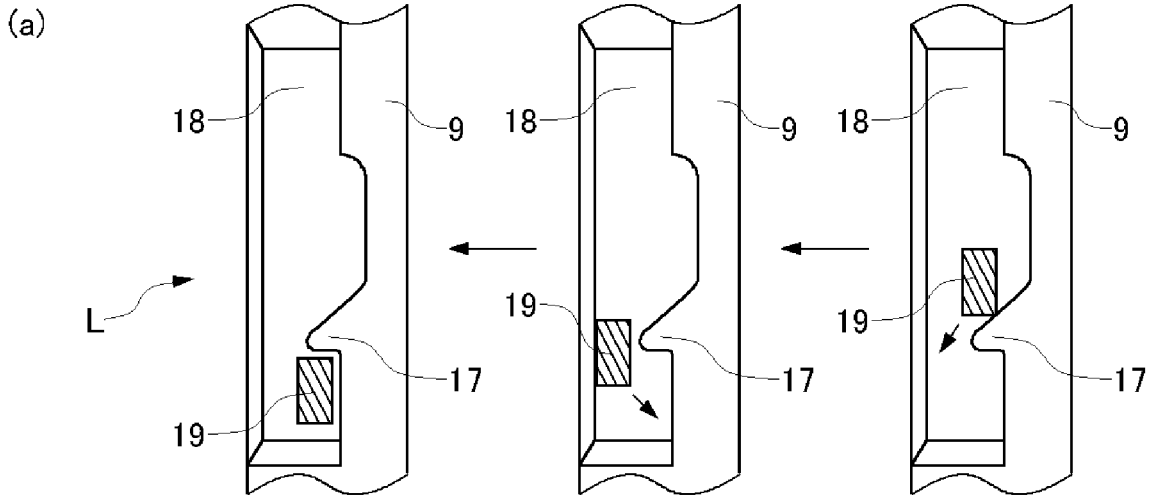
FIG. 6A is a schematic explanatory view illustrating a structure in which a locking device in the engagement member in the card shooter device is brought into a locked state.
Figure 6B:
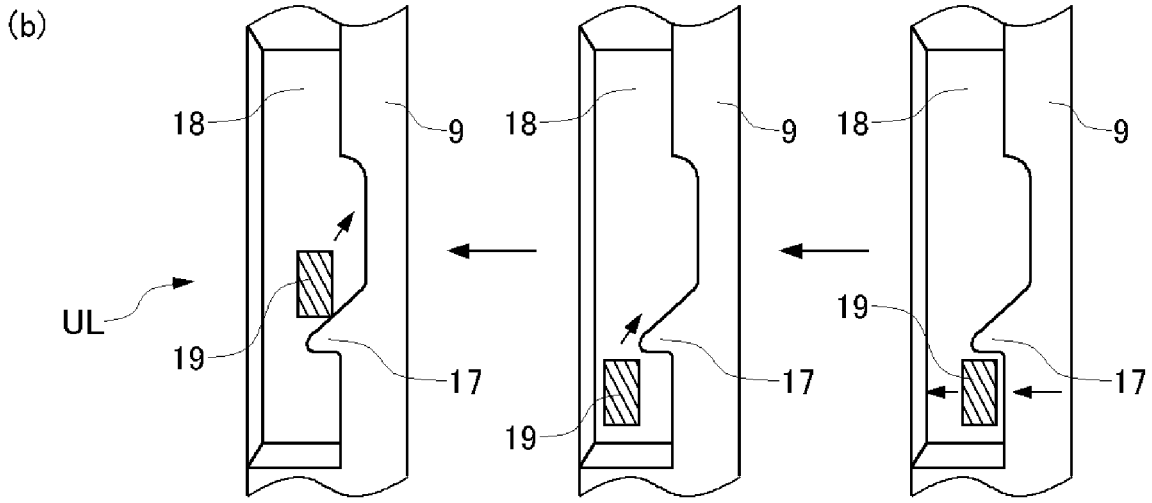
FIG. 6B is a schematic explanatory view illustrating a structure in which the locking device in the engagement member in the card shooter device is released.

The engagement member 9 is provided with a groove 18 inside which a locking protrusion 17 is mounted, as illustrated in FIG. 4, and a button 20 having a bar-shaped button extension section 19 on its bottom is further mounted, as illustrated in FIGS. 5 to 7, on the back, mounted on the engagement member 9, of the front cover 8 (a locking device). When the front cover 8 is slid while overlapping the engagement member 9 along the obliquely downward arrow X from above the engagement member 9, the button extension section 19 on the bottom of the button 20 mounted on the front cover 8 enters the groove 18 in the engagement member 9, and advances after passing through a gap between the groove 18 and the locking protrusion 17 in the groove 18. However, after passing through the gap, the button extension section 19 is designed not to be returned by being caught by the locking protrusion 17 if the button extension section 19 attempts to be returned in an opposite direction (a lock (L) state). When the button 20 on the top of the button extension section 19 is pushed along an arrow Y inward from outside while being slid in an opposite direction to the arrow X, the button extension section 19 can be returned to its original state after moving inward simultaneously with the button 20 and passing through the gap between the groove 18 and the locking protrusion 17 in the groove 18 (an unlock (UL) state). The button 20 and the button extension section 19 are connected to the front cover with a member having a structure of an elastic spring s interposed therebetween. The button extension section 19 returns to its original state when the button 20 is released after being pushed with a finger inward from outside. Therefore, the front cover 8 is designed to be required to be removed by being slid in an obliquely upward direction (in an opposite direction to the arrow X) while the button 20 is pressed. Thus, a hook-shaped member, a magnet, and the elastic spring s can also be used to make the front cover 8 and the card shooter device 1 removable from each other in addition to a meshing structure and a locking structure formed between the front cover 8 and the engagement member 9.

Figure 8:
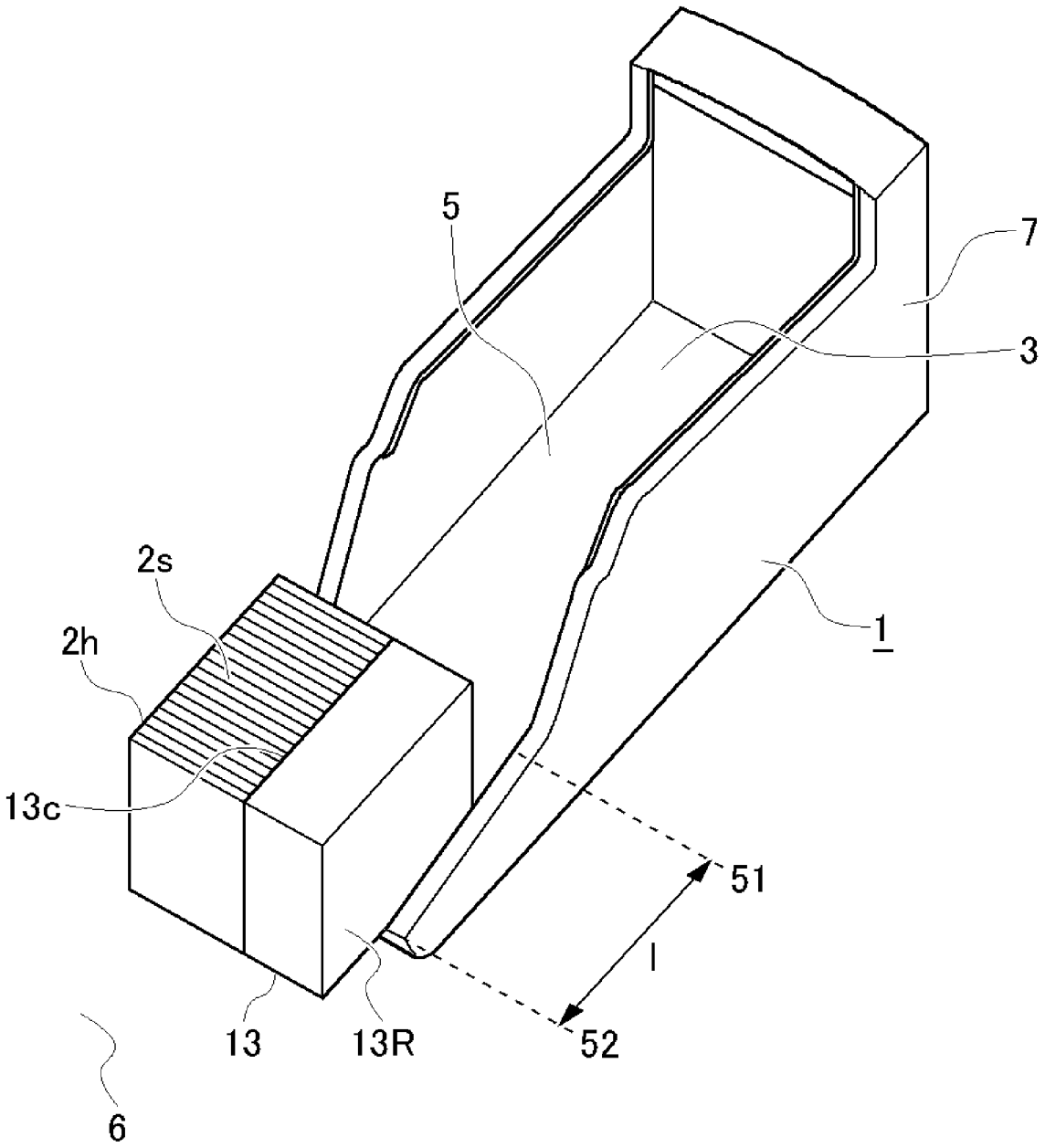
FIG. 8 is a perspective view in a state where the packing box is installed in front of a bottom face in the card shooter device after its side surface is removed.

The card shooter device 1 is preferably adapted so that a length 1 from a position 51 at a leading end on the lower side of the front cover 8 to a leading end 52 of the main unit on the bottom face 5 is not less than half the length in a longitudinal direction of the packing box 13 storing the cards 2*s* when the front cover 8 is mounted (see FIG. 8). When the card shooter device 1 is thus adapted, the cards 2*s* in the packing box 13 respective side surfaces of which remain exposed can be stably placed on the bottom face 5 from the position 51 at the leading end on the lower side of the front cover 8 to the leading end 52 of the main unit when the front cover 8 is mounted, i.e., the cards 2*s* can be prevented from being inclined in a direction of the game table 6. Therefore, workability in arranging the order of the cards 2*s* is improved.

Figure 9A:
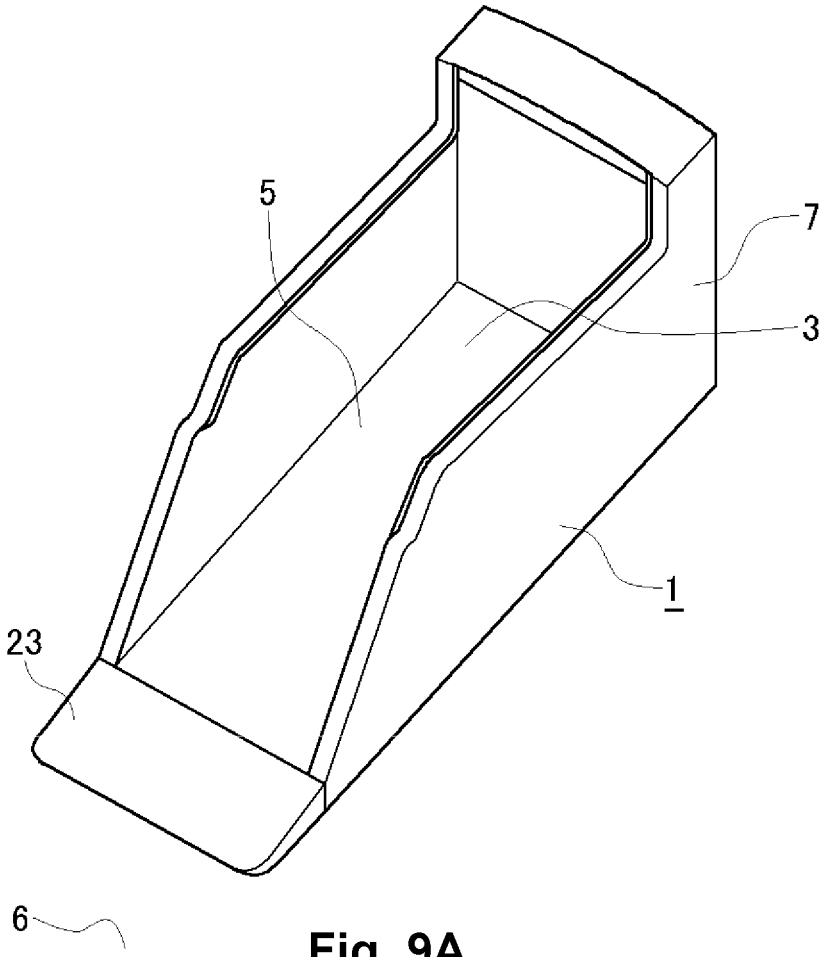
FIG. 9A is a perspective view in a state where there is provided an inclined extension body inclined from a leading end of the bottom face in the card shooter device to continue to an upper surface of a game table.
Figure 9B:
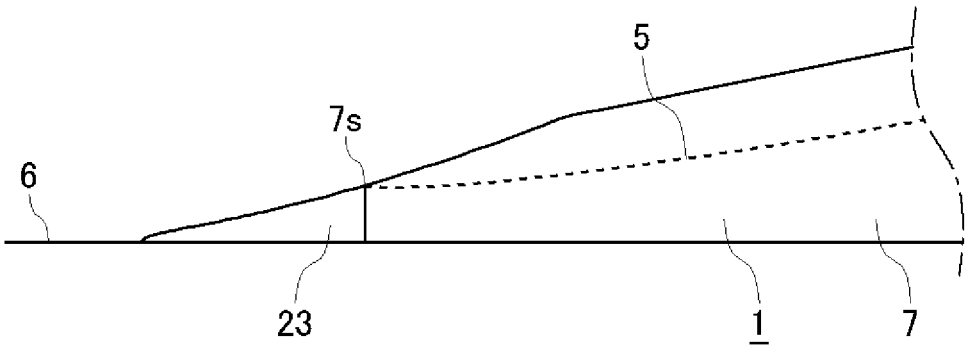
FIG. 9B is a partially side view in the state.

The bottom face 5 may be formed to continue to the upper surface of the game table 6 by adapting the card shooter device 1 so that an inclined extension body 23 having its leading end contacting the game table 6 is separately installed at the leading end 52 of the main unit and the leading end of the inclined extension body 23 contacts the game table 6 (see FIGS. 9A-B). When the card shooter device 1 is thus configured, the cards 2*s* in the packing box 13 the side surfaces of which remain exposed can be slid into the card storage section 3 from the front of the main unit 7 after the order of the cards 2*s* is arranged once after being placed to extend over the game table 6 and the leading end 52 of the main unit. A case where the bottom face 5 continues to the upper surface of the game table 6 also includes a case where there is a step between the leading end of the inclined extension body 23 and the game table 6 in a range in which the cards 2*s* are slid into the card storage section 3 between the bottom face 5 and the game table 6 without any difficulty. The leading end 52 of the main unit may contact the game table 6 instead of the inclined extension body 23 being used. When the card shooter device 1 is thus configured, restrictions on a location where the cards 2*s* are placed are loosened. Therefore, workability in arranging the order of the cards 2*s* is improved.

Figure 10:
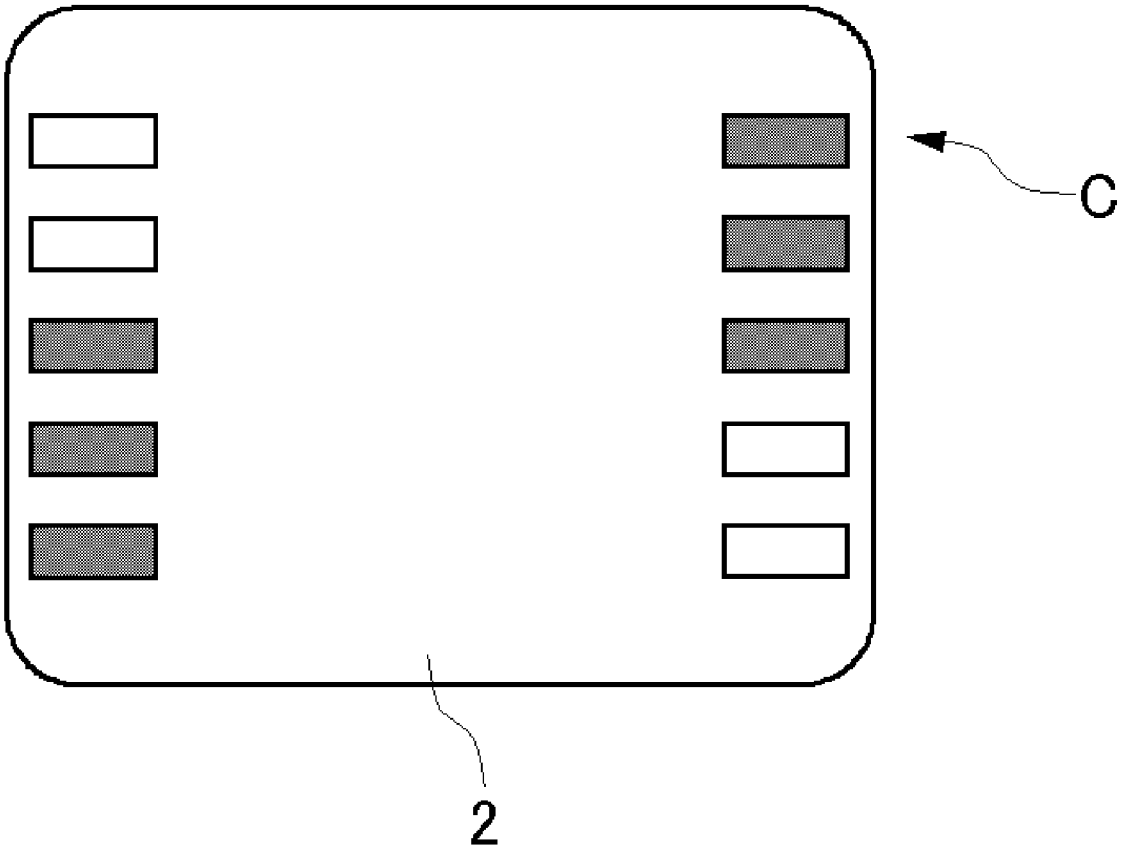
FIG. 10 is a plan view of the card.

FIG. 10 illustrates a card 2 constituting the card 2*s*. On the card 2 used for a table game such as baccarat, a numeric character is coded, and is printed as codes C with UV (ultraviolet) ink or the like which is generally invisible. The codes C are respectively point-symmetrically provided on the upper side and the lower side of the card 2. The code C is printed with paint which is visualized by receiving ultraviolet light, and is desirably printed at a position not overlapping a type notation and an index of a card.

Figure 11:
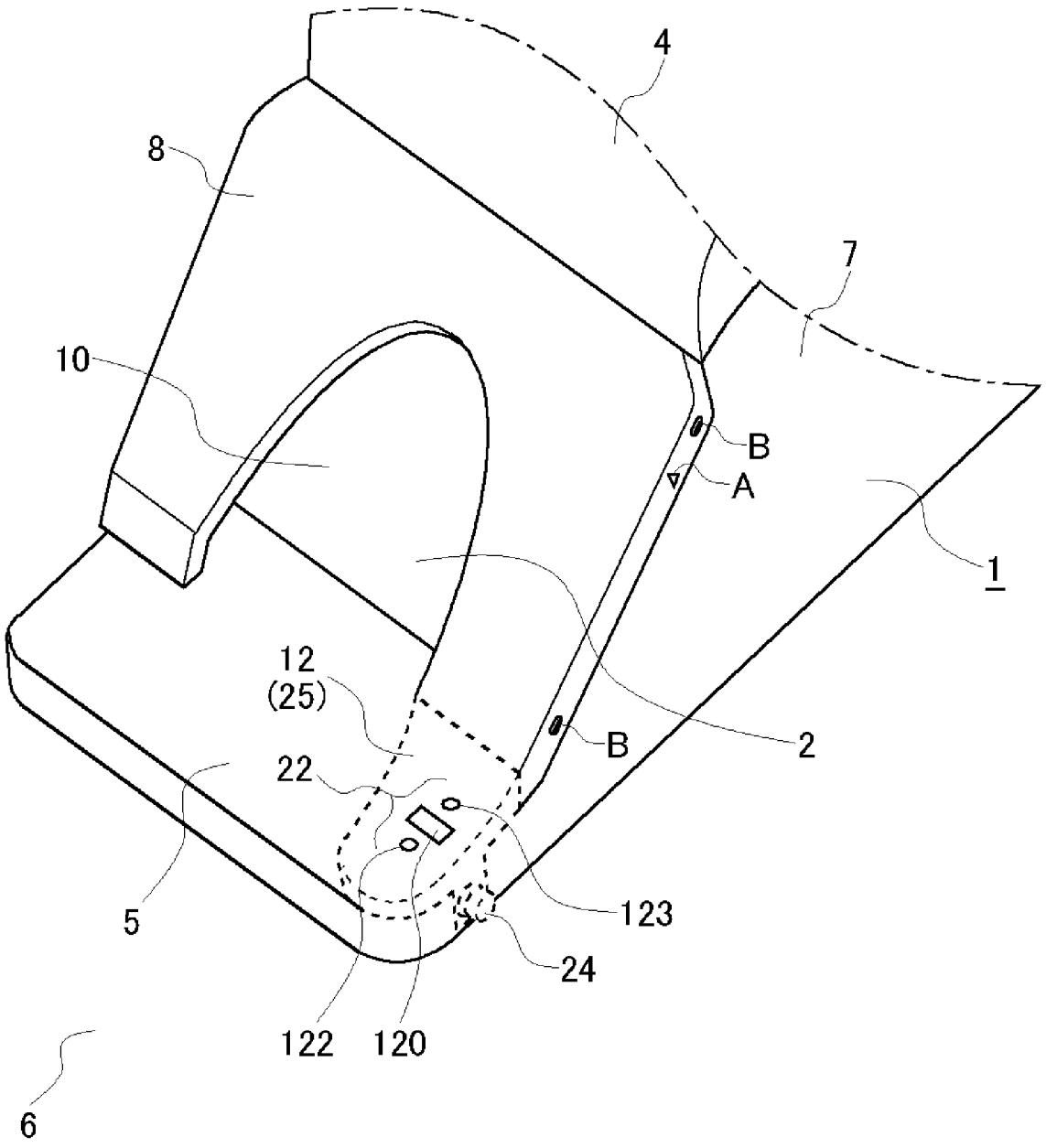
FIG. 11 is an enlarged perspective view of a principal part in a state where a card reading device at a leading end of the card shooter device is exposed.
Figure 12:
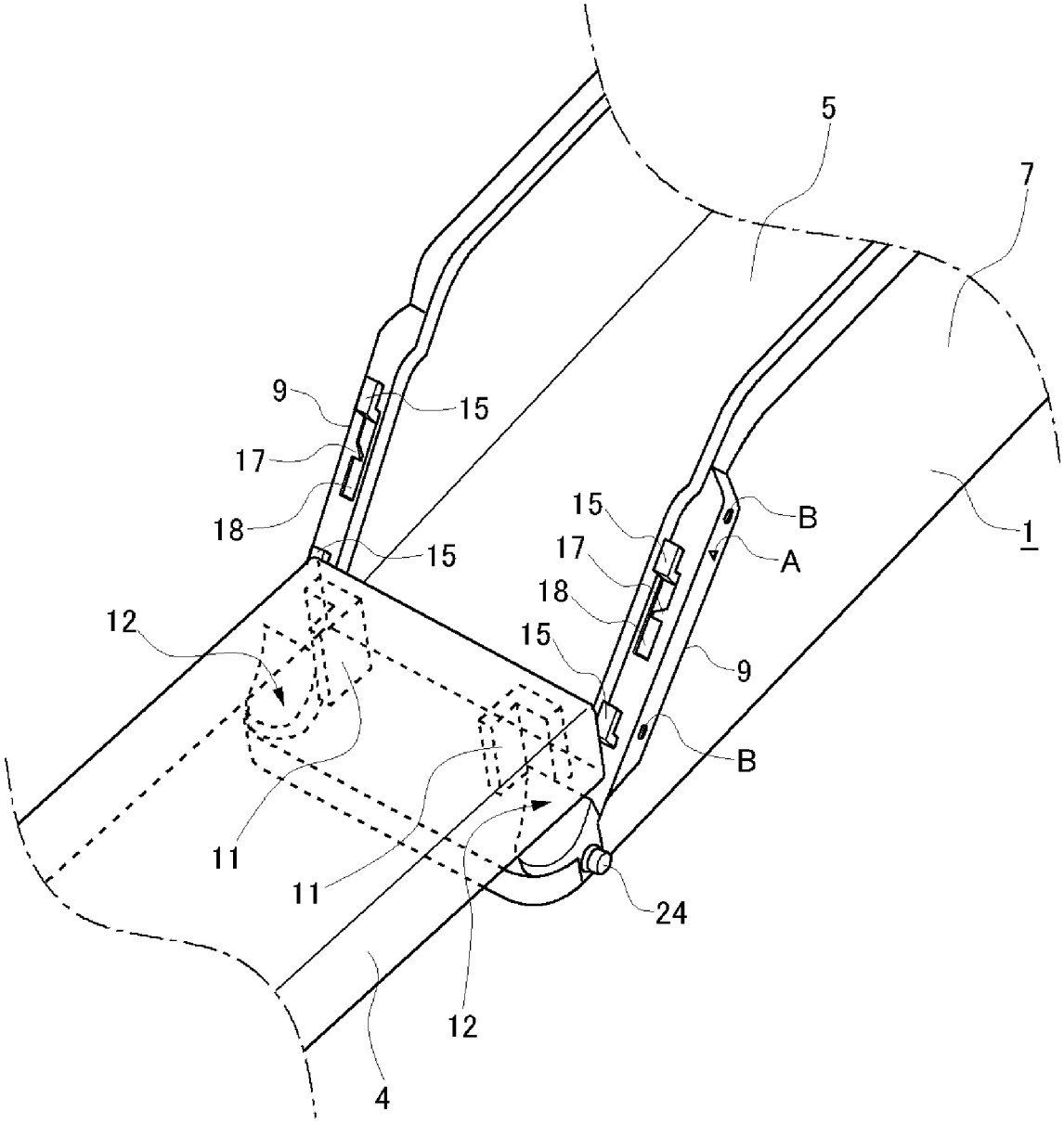
FIG. 12 is an enlarged perspective view of a principal part in a state where an extension member is locked at the leading end of the card shooter device.

Details of a reading device 22, which reads the codes C representing a numeric character (a place, a number, a rank) on the card 2 when the card 2 is manually extracted from the card storage section 3 will be described below with reference to FIG. 11. The reading device 22 is provided on the bottom face 5 for guiding the cards 2 manually extracted one by one from the opening 10 in front of the card storage section 3 on the game table 6. When the locking member 12 also used as a reading device cover 25 for covering a sensor group in the reading device 22 is removed, the sensor group in the reading device 22 is exposed (the reading device cover 25 is removable with a screw). The sensor group includes an ultraviolet reaction sensor (UV sensor) 120 and two object detection sensors 122 and 123, for example.

In the reading device 22, a control section (not illustrated) controls the start and the end of reading of the UV sensor 120 based on respective detection signals of the object detection sensors 122 and 123. The control section (not illustrated) determines whether the card 2 has normally passed over the bottom face 5 based on the detection signals of the object detection sensors 122 and 123. As illustrated in FIG. 10, square codes C each representing a rank (number) and a suit (heart, spade, etc.) of the card are arranged in two rows and four columns at edges of the card 2. The UV sensor 120 outputs an on signal when it detects the code C. The reading device 22 determines a relative relationship between both signals input from the UV sensor 120. Thus, the reading device 22 specifies the code depending on a relative difference between the two codes C detected by the UV sensor 120, for example, and specifies a number (a rank) and a type (suit) of the corresponding card 2.

Thus, the control device (not illustrated) determines victory or defect of a game based on the number (rank) of the card 2 read from the card 2.

While the reading device cover 25 functions to protect the sensor group in the reading device 22 from damage, the reading device cover 25 may be adapted to function as the locking member 12.

While the preferred embodiment of the present invention considered at this time has been described above, it is understood that various modifications to the present embodiment can be made and it is intended that all such modifications within the true spirit and scope of the present invention are included in attached claims.

A card shooter device according to the present invention and a method for storing cards in a card storage section in the card shooter device are useful for a playing game in a casino or the like because they make it easy to store the cards in the card storage section in the card shooter device prior to the playing game and can prevent a mistake of erroneously scattering the cards to break a deck.

REFERENCE SIGNS LIST

1 Card shooter device
2 Card
2*s* Cards constituting a predetermined number of decks
3 Card storage section
4 Top face cover
5 Bottom face
6 Game table
7 Main unit
8 Front cover
9 Engagement member
10 Opening
11 Protrusion
12 Locking member
13 Packing box
14 Cut card
15 Hook
16 Hook receiving section
17 Locking protrusion
18 Groove
19 Button extension section
20 Button
21 Extension member
22 Reading device
23 Inclined extension body
24 Screw
25 Reading device cover
C Code
A Mark

The invention claimed is:

1. A method, using a packing box that is configured to store cards constituting a predetermined number of decks, to store the cards from the packing box in a card shooter device for dealing the cards on a game table, wherein the packing box has a rectangular parallelepiped shape and includes a cut line parallel to a longitudinal direction of the rectangular parallelepiped shape, and wherein the card shooter device comprises a main unit including a card storage section in which the cards constituting the predetermined number of decks can be stored, a bottom face that is inclined for guiding the cards onto the game table from the card storage section, and a front cover that is provided in front of the main unit and is removably mounted on the main unit in cooperation with an engagement member, the method comprising:

removing the front cover from a front side of the main unit;

exposing respective side surfaces of the cards in the packing box by dividing the packing box along the cut line to remove a left side surface or a right side surface of the packing box;

sliding the packing box, while the cards are in the packing box, into the card storage section, wherein, during the sliding, the bottom face of the main unit guides the packing box into the card storage section via the front side of the main unit from which the front cover was removed; and subsequent to the sliding, removing the packing box from the card storage section, leaving in the card storage section the cards that were previously in the packing box.

2. The method for storing cards according to claim 1, further comprising:

placing an extension member at a front end of the main unit so that a top surface of the extension member continues to the bottom face of the card storage section; and placing the packing box, including therein the cards whose side surfaces are exposed, at least partially onto the extension member, wherein the sliding is performed subsequent to the placing of the pacing box.

3. The method for storing cards according to claim 2, wherein the extension member is a removable top face cover arranged on top of the card storage section for covering the card storage section.

4. The method for storing cards according to claim 2, further comprising locking the placed extension member at the front end of the main unit.

5. The method for storing cards according to claim 4, wherein the locking is performed using a protrusion and a lock that is arranged to lock the extension member with the protrusion.

6. The method for storing cards according to claim 5, wherein the lock is a reading device cover arranged at the front end of the main unit for covering a reader that is configured to read the cards when the cards extracted one by one from the card storage section.

7. The method for storing cards according to claim 3, further comprising locking the placed extension member at the front end of the main unit.

8. The method for storing cards according to claim 7, wherein the locking is performed using a protrusion and a lock that is arranged to lock the extension member with the protrusion.

9. The method for storing cards according to claim 8, wherein the lock is a reading device cover arranged at the front end of the main unit for covering a reader that is configured to read the cards when the cards extracted one by one from the card storage section.

* * * * *